US011655096B1

(12) United States Patent
Effler

(10) Patent No.: US 11,655,096 B1
(45) Date of Patent: May 23, 2023

(54) UNIVERSAL CAULKING GUN, CONVERSION KIT, AND METHOD CONVERTING A STANDARD CAULKING GUN INTO A UNIVERSAL CAULKING GUN

(71) Applicant: Jason John William Effler, Shelburne (CA)

(72) Inventor: Jason John William Effler, Shelburne (CA)

( * ) Notice: Subject to any disclaimer, the term of this patent is extended or adjusted under 35 U.S.C. 154(b) by 0 days.

(21) Appl. No.: 17/736,444

(22) Filed: May 4, 2022

(51) Int. Cl.
*B65D 88/54* (2006.01)
*B65D 83/00* (2006.01)
*B05C 5/02* (2006.01)

(52) U.S. Cl.
CPC ..... *B65D 83/0022* (2013.01); *B05C 5/0225* (2013.01)

(58) Field of Classification Search
CPC ..... B65D 83/0022; B05C 5/0225
See application file for complete search history.

(56) References Cited

U.S. PATENT DOCUMENTS 3,813,012 A 5/1974 Laird
4,331,267 A 5/1982 Duncan et al.
5,595,327 A 1/1997 Dentler et al.
6,041,976 A 3/2000 Robertson
6,220,485 B1 4/2001 Chang
6,454,136 B1 9/2002 Evans
6,892,904 B2 5/2005 Osborn et al.
7,014,070 B1 * 3/2006 Stefely ..... B05C 17/01 222/391
8,528,785 B2 9/2013 Naughton
9,630,204 B2 5/2017 Hung
2007/0181607 A1 * 8/2007 Calvo ..... B05C 17/0126 222/391
2007/0235475 A1 * 10/2007 Schneider ..... B05C 17/00576 222/326
2016/0288162 A1 * 10/2016 Hung ..... B05C 17/00576
2018/0066795 A1 * 3/2018 Polley ..... F16N 3/12

* cited by examiner

*Primary Examiner* — Bob Zadeh
(74) *Attorney, Agent, or Firm* — Stratford Group Ltd.

(57) ABSTRACT

A universal caulking gun and method of converting a standard caulking gun into a universal caulking gun are disclosed, along with a kit of parts for converting a standard caulking gun into a universal caulking gun. The universal caulking gun that is capable of accommodating both small and large caulking tubes. It includes a combination of small and large plunger members that are configured to be removably attached to the caulking gun rod. The small and large plunger members are sized and configured to nest together and form a single plunger unit corresponding to the internal diameter of a large caulking tube. Alternatively, the small and large plunger members are separable such that the single plunger unit corresponds to the internal diameter of a small caulking tube and the large plunger can be retained in a non-functional position.

16 Claims, 4 Drawing Sheets

UNIVERSAL CAULKING GUN, CONVERSION KIT, AND METHOD CONVERTING A STANDARD CAULKING GUN INTO A UNIVERSAL CAULKING GUN

FIELD OF THE INVENTION

The present invention relates generally to the field of universal caulking guns, specifically to kits of parts for caulking guns, more specifically to a kit of parts to convert a standard caulking gun into a universal caulking gun.

BACKGROUND

Any discussion of the related art throughout the specification should in no way be considered as an admission that such related art is widely known or forms part of common general knowledge in the field.

U.S. Pat. No. 7,014,070 (Stefely) discloses a multi-purpose caulking gun. The caulking gun is designed to dispense mastic compounds from disposable caulk tubes with body lengths of 20.3 to 21.6 cm, (8.0 to 8.5 inches) and caulk tubes which have variable outer diameters, ranging from 4.4 to 6.7 cm (1.75 to 2.63 inches). The caulking gun has a conventional structure including a cradle for receiving disposable caulk tubes, a forward end plate with a slot for retaining and centering the spout of the caulk tube, a push rod assembly with an attached thrust disk means on one end, and an activating mechanism to move the push rod forward, causing the thrust disk means to contact and move the tube plunger to dispense mastic compound from the caulk tube. The caulking gun differs from conventional designs in that the forward end plate can be modified to hold tubes which have variable outer diameters but similar caulk tube body lengths, and that there may be multiple thrust disks. A small thrust disk, situated directly behind a large thrust disk, is attached securely to an end of the push rod designed to fit into a plunger of a caulk tube. The large thrust disk is designed to fit exclusively into plunger of a large caulk tube. It is situated directly behind the small thrust disk that is designed to slide along the length of the push rod unless locked in place by a mechanical means, such as a dowel pin, a pressure place that bites into the push rod, a notch, a screw, or a locking collar. The shortcomings of this device include having the small thrust disk permanently fixed to the push rod. Not only is the small thrust disk permanently fixed to the push rod but the large thrust disk, that is situated on the other side of the small thrust disk, is also permanently attached to the push rod. Hence when the push rod or either of the small or large thrust disks are damaged or bent by wear and tear, or corroded or rusted, it is necessary to purchase a new caulking gun.

U.S. Pat. No. 6,220,485 (Chang) discloses an extended piggy back dispensing device with interchangeable application guides. The piggy back assembly comprises a second barrel assembly adapted to be seated piggyback inside a larger barrel assembly for accommodating another size of cartridge. An interchangeable push-disk piston mounted on the distal end of the piston rod, and a smaller barrel assembly adapted to be seated inside the other larger barrel assembly to accommodate a smaller-sized cartridge. The smaller barrel assembly piggybacks in the larger, and the push-disk piston swaps out, thereby making it possible to use one extended gun for at least two different-sized cartridges, such as the typical ¼ gallon cartridges and ⅒th gallon cartridges. This device requires several different parts to be assembled and disassembled on a job site, when changing from one size of caulking tube to another, which is not convenient and often results in parts being lost or misplaced.

U.S. Pat. No. 9,630,204 (Hung) discloses a plunger for a caulking gun. This device provides a caulking gun having a structure or configuration for allowing the plunger to be easily and quickly attached or mounted or secured to the piston rod and for allowing the plunger to engage with different dispensing cartridges. Again this type of modification entails several different parts to be assembled and disassembled on a job site, often resulting in parts being lost or misplaced.

U.S. Pat. No. 6,892,904 (Osborn) discloses a grouting gun apparatus and method. The apparatus is for applying sealing material has a plunger with a flexible outer surface and with an extended position and a compressed position. The shortcomings of this design include the resistance encountered when withdrawing the plunger. When the flexible plunger if moved down the cartridge to dispense the grout, the flexible edge is forced up the cartridge. Hence, when the plunger is withdrawn. The flexible outer surface must flex through 180 degrees in order to release the cartridge. This motion causes the flexible outer surface to wear and tear and therefore required frequent replacement.

U.S. Pat. No. 3,813,012 (Laird) discloses an air powered sealant dispenser, including flexible tubular conduits as valve means. The invention provides a lower cost air powered dispenser in which cartridges varying not only in length but also in diameter and cartridges varying in type, such as the more expensive plastic versus the less costly paper cartridges, may be dispensed by a single universal air powered gun. A series of a threaded expansion rings are required to cooperate with the air powered dispensed that are specifically designed and configured to function with an air gun which are not suitable for use with a manual caulking gun.

U.S. Pat. No. 6,041,976 (Robertson) discloses an adhesive dispensing tool for use with a rotary power tool. A caulking gun or adhesive dispensing tool is driven by an expandable drive mechanism. The drive mechanism comprises a threaded shaft interfitting with the threaded inner surface of a receiving sleeve. The sleeve carries a pusher plate into a caulk receptacle for engaging a tube of adhesive material. The shaft is attachable to the chuck of a common drill. Caulk tubes come in several different sizes, such as 11 ounce and 28 ounce tubes, and the preferred embodiment can be constructed to accommodate the desired size. The shortcomings of this tool include not being adjustable to accommodate caulking tubes of different sizes. Differently sized tools are manufactured to accommodate different sized caulking tube.

U.S. Pat. No. 8,528,785 (Naughton) discloses a powered dispensing tool. The powered dispensing tool includes a housing, a motor, a rack operably coupled to the motor for powered translation along a longitudinal axis in at least one of a forward direction and a reverse direction, a transmission housing at least partially positioned within the housing through which the rack is extendable, first and second plungers, at least one of which is coupled to one end of the rack, and a first cartridge housing within which first and second material cartridges may be supported in a side-by-side relationship. The first and second plungers are associated with the first and second material cartridges, respectively. The tool also includes a second cartridge housing within which only a single material cartridge may be supported. The shortcomings include the first and second cartridge housings must be interchangeably coupled to the transmission housing to adapt the tool for use with dual material cartridges or single material cartridges.

U.S. Pat. No. 4,331,267 (Duncan) discloses a caulking tube plunger and enclosure assembly. A combined caulking tube plunger and enclosure assembly is disclosed which includes a single piece of drawn metal in generally a cup-shaped configuration including a bottom wall, a circular or annular side wall which forms a close fit with the inside diameter of a caulking tube and which provides guidance of the plunger portion through the caulking tube, and an outer rim which is adapted to be rolled over the outer end of a caulking tube to form a closure and seal therewith. A circumferential break-away score or dart is formed in the side wall axially inwardly of the rim which causes the major portion of the side wall and the bottom wall, forming a plunger, to be broken away from the rim upon the application of force by the ram of a caulking gun thus to separate the plunger portion from the rim portion. The disadvantage of this device is that it does not work with different sizes of caulking tubes.

U.S. Pat. No. 5,595,327 (Dentler) discloses a caulking gun with tube engaging receptacle. The caulk gun having a piston with a flexible rim providing dripless dispensing of caulk or adhesive and including a tube-engaging receptacle for securely holding a tube is disclosed. A shortcoming of this device is that it does not work with different sizes of caulking tubes.

U.S. Pat. No. 6,454,136 (Evans) discloses an extendable caulking gun. The gun includes a cylindrical housing having an open first end, an open second end, and a hollow interior. A trigger assembly is coupled with respect to the open first end of the cylindrical housing. The trigger assembly includes an L-shaped trigger housing secured to the open first end of the cylindrical housing. A caulk tube holder is slidably received within the open second end of the cylindrical housing. The caulk tube holder is adapted for holding a tube of caulk therein. The caulk tube holder is coupled with the trigger assembly. Again, this device does not work with different sizes of caulking tubes.

All documents cited herein are incorporated by reference.

None of the above cited documents, alone or in combination satisfy the need for a compact manual caulking gun that can easily be adjustable to receive different diameter caulking tubes that does not require additional parts to be separately fitted. There is consequently the need for a device that addresses the above-mentioned deficiencies.

BRIEF SUMMARY

It is an object of the invention to provide a universal caulking gun and conversion kit.

In accordance with an aspect of the invention there is provided a universal caulking gun, comprising: a gun body, having a cartridge holder adapted for receiving a large caulk cartridge; a rod movably assembled to the gun body, a first threaded end of said rod extending into the cartridge holder, a second end of said rod extending beyond said gun body; a handle having a hingedly mounted trigger, said trigger operably associated with said rod to extend said first threaded end of said rod into said cartridge; a small and a large plunger sized and configured to nest together and form a single plunger unit having an external diameter corresponding to the internal diameter of a large caulking tube, said small and large plungers having a central bore hole having a diameter corresponding to an external diameter of said rod; and a pair of threaded nuts sized and configured to engage with the threaded end of said rod, wherein when said small and said large plungers are nested together and secured in place by said pair of threaded nuts, said first threaded end having a length to accommodate said plunger unit and said pair of threaded nuts, said universal caulking gun can be used to apply caulk or adhesive to a work surface from a large caulking tube.

In accordance with another aspect of the invention there is provided A kit of parts to convert a large caulking gun into a universal caulking gun, said kit comprising: a rod having a first threaded end configured to extend into a cartridge holder of said caulking gun, and a second end of said rod extending beyond said caulking gun; a small and a large plunger sized and configured to nest together and form a single plunger unit having an external diameter corresponding to the internal diameter of a large caulking tube, said small and large plungers having a central bore hole having a diameter corresponding to an external diameter of said rod; and a pair of threaded nuts sized and configured to engage with the threaded end of said rod, wherein when said small and said large plungers are nested together and secured in place by said pair of threaded nuts, said first threaded end having a length to accommodate said plunger unit and said pair of threaded nuts, said universal caulking gun can be used to apply caulk or adhesive to a work surface from a large caulking tube.

The advantages and features of the present invention will become better understood with reference to the following more detailed description and claims taken in conjunction with the accompanying drawings in which like elements are identified with like symbols.

To easily identify the discussion of any particular element or act, the most significant digit or digits in a reference number refer to the figure number in which that element is first introduced.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1A:
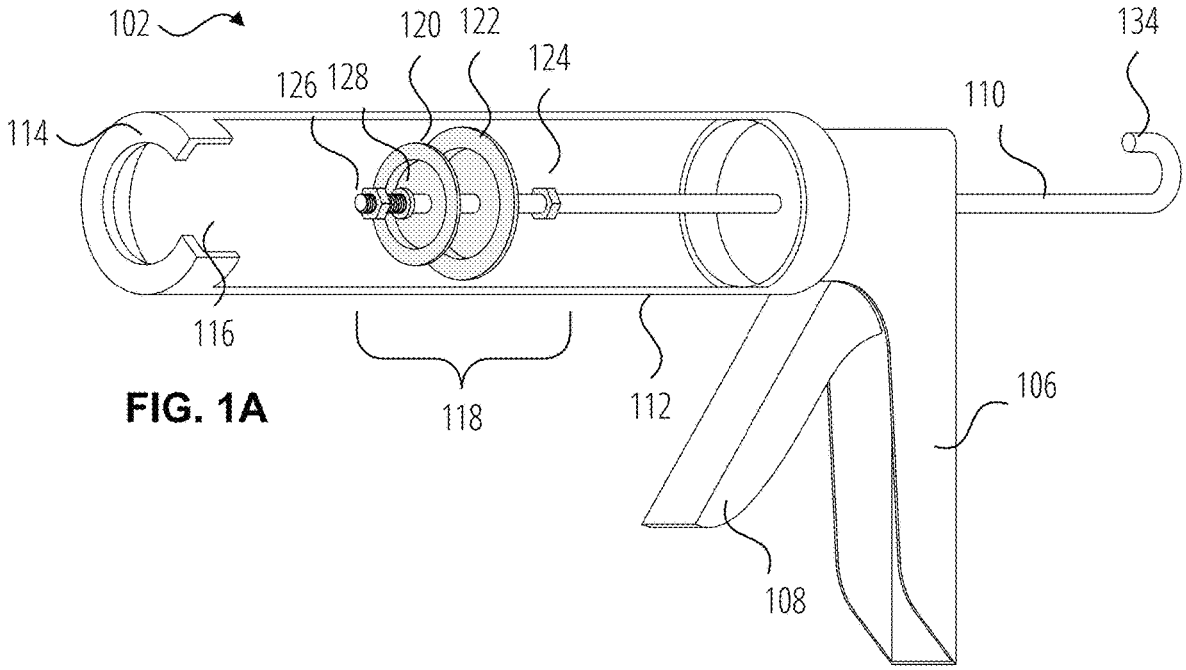
FIGS. 1A and 1B illustrate side perspective views of the subject matter in accordance with one embodiment of the invention.

Embodiments of the invention include a universal caulking gun that is capable of accommodating both small and large caulking tubes. It includes a combination of small and large plunger members that are configured to be removably attached to the caulking gun rod.

In one embodiment of the invention, the small and large plunger members are sized and configured to nest together and form a single plunger unit corresponding to the internal diameter of a large caulking tube. In another embodiment of the invention the small and large plunger members are separable such that the single plunger unit corresponds to the internal diameter of a small caulking tube and the large plunger can be retained in a non-functional position.

Other embodiments of the invention include a kit of parts that are capable of converting a standard known large caulking gun into a universal caulking gun that can accommodate both small and large caulking tubes with minimal adjustment. All parts that are required to convert the universal caulking gun from one format to another being removably attached the rod of the caulking gun. The kit of parts selected from the group including, but not limited to: a rod that is modified to have an extended threaded section; a large plunger having a central hole configured to slide along the rod; a small plunger having a central hole configured to slide along the rod; two washers configured to slide along the rod; and two nuts configured to engage with the threaded section.

Other kits of parts can be assembled comprising parts to replace individual components from standard caulking guns that have become damaged.

Devices and methods for carrying out the invention are presented in terms of embodiments depicted within the FIGS. However, the invention is not limited to the described embodiments, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and the configurations shall be shown and described for purposes of clarity and disclosure and not by way of limitation of scope.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

The term "connected", "attached", "affixed" or "coupled to" may include both direct coupling (in which two elements that are coupled to each other contact each other) and indirect coupling (in which at least one additional element is located between the two elements). There are two standard size disposable caulk tubes available in general commerce: a small size; and a large size. The small size has a body length of 20.3 to 21.6 cm. (8.0 to 8.5 inches), and has an outer diameter of 4.4 to 5.1 cm (1.75 to 2.0 inches), and has a net content of approximately 0.31 liters (10.5 fluid ounces) of caulk/adhesive/mastic compound. The large size has a body length of 31.0 to 31.8 cm (12.25 to 12.50 inches), and has an outer diameter of 6.0 to 6.7 cm (2.4 to 2.6 inches), and has a net content of approximately 0.9 liter (30 fluid ounces) of caulk/adhesive/mastic compound.

FIG. 1A shows a side perspective view of large caulking gun configured fit large tube of caulking 102.

The body of caulking gun 112 typically comprises a cylindrical outer section sized and configured to receive a large tube of caulking. The body of caulking gun 112 further comprises similar parts as a known large caulking gun including a handle 106, and a trigger 108 cooperatively linked to the rod 110. The rear end of the body of caulking gun 112 is solid with a hole sized and proportioned to accommodate the rod. The other end of the body of caulking gun 112 comprises an end stop 114 to retain the large diameter tube of caulking 206 of a small diameter caulking tube 212. An opening 116 in the end stop 114 allows for easy insertion of the large diameter tube of caulking 206 or small diameter caulking tube 212.

The rod 110, of one embodiment of the invention, comprises a shaft having a hook or end stop 134 at one end and a threaded section 130 at the other. The shaft of the rod 110 fits through an opening in the rear end of the body of caulking gun 112. The rod extends into the inner body of the body of caulking gun 112. A large plunger 122 and a small plunger 120 are configured to have an external diameter to fit inside and cooperate with a large or small tube of caulking, respectively. The large plunger 122 and small plunger 120 also have a hole in the center (not shown) that is sized and configures to receive the rod. The large plunger 122 and small plunger 120 are shaped to fit together, the outer domed side of the small plunger 120 sized to fit inside the inner surface of the large plunger 122.

In operation, for a large caulking gun configured fit large tube of caulking 102 as shown in FIG. 1A, the small plunger 120 and large plunger 122 are oriented as shown in the exploded large plunger section 118. The rear nut 124 is threaded onto the threaded section 130 and the nested or aligned small plunger 120 and large plunger 122 slotted onto the threaded section 130 followed by the front nut 126. Typically, suitably sized washers (not shown) may be inserted between the rear nut 124 and the large plunger 122, and the front nut 126 and the small plunger 120.

The specific orientation of the small plunger 120 and large plunger 122 can be reversed by rotating the exploded large plunger section 118 as illustrated through 180 degrees.

Figure 1B:
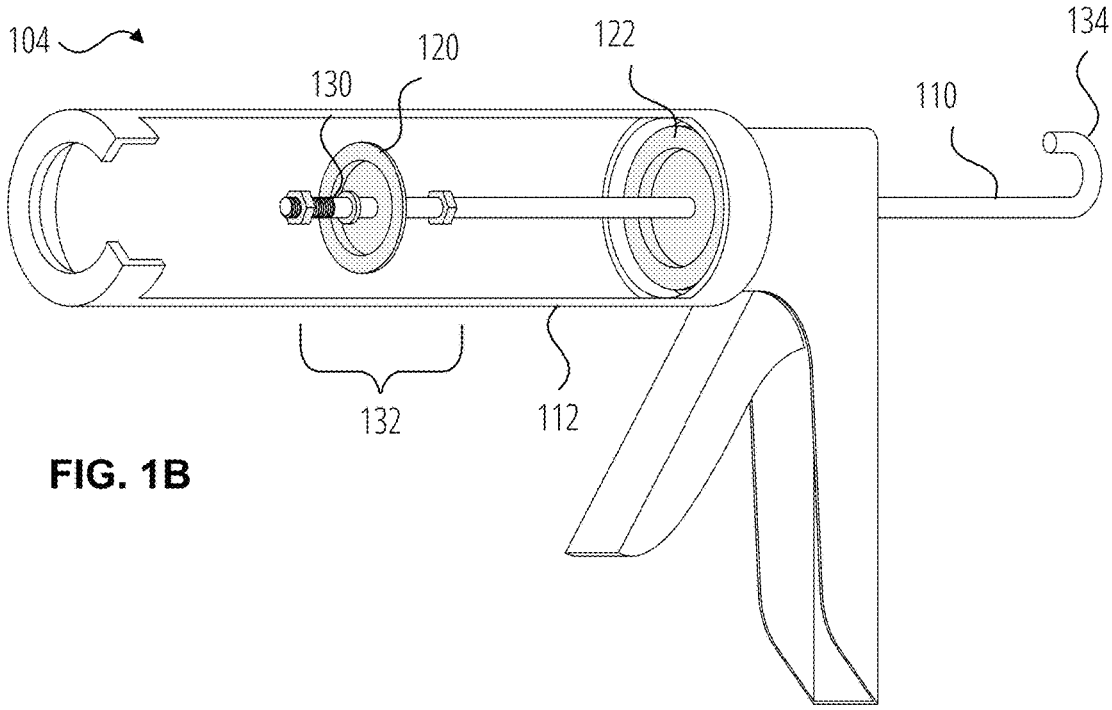

FIG. 1B shows a side perspective view of large caulking gun configured fit small tube of caulking 104.

In operation, for a large caulking gun configured fit small tube of caulking 104 as shown in FIG. 1B, the small plunger 120 and large plunger 122 are oriented as shown in the exploded small plunger section 132. The large plunger 122 is slotted onto the rod 110. The rear nut 124 is threaded onto the threaded section 130 and the small plunger 120 slotted onto the threaded section 130 followed by the front nut 126. Typically, suitably sized washers (not shown) are inserted between the rear nut 124 and the small plunger 120, and the front nut 126 and the small plunger 120.

Figure 2A:
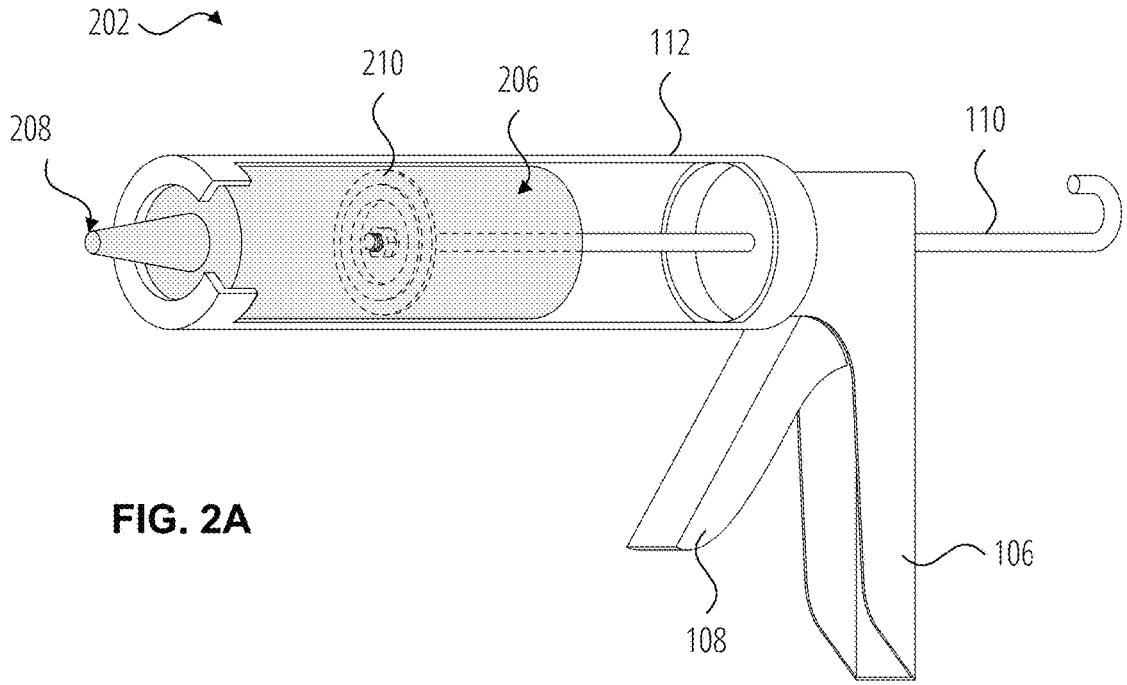
FIGS. 2A and 2B illustrate side perspective views of the use of the subject matter in accordance with one embodiment of the invention of the invention.

FIG. 2A shows a large caulking gun with large tube of caulking 202 installed within the body of caulking gun 112.

The parts shown in the exploded large plunger section 118 are compacted together and secured onto the threaded section 130 by way of a combination of washers and a rear nut 124 and front nut 126. The caulking nozzle 208 of the large diameter tube of caulking 206 is inserted into the large caulking gun and the compacted small plunger 120 and large plunger 122 are engaged with the other end of the large diameter tube of caulking 206. Actuation of the trigger 108 causing the rod 110 to move in a forward direction, forcing the compacted large plunger 122 and small plunger 120 against the end of the large diameter tube of caulking 206 which causes the caulk contained within to exude out through the caulking nozzle 208.

Figure 2B:
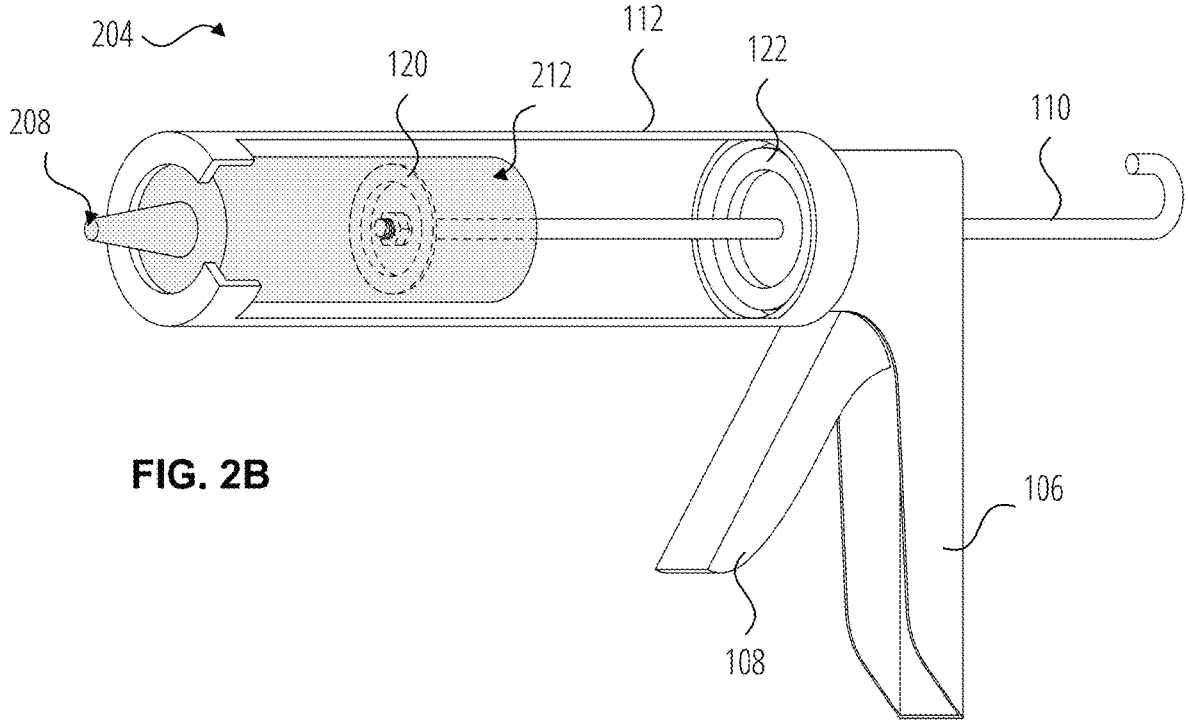

FIG. 2B shows a large caulking gun with small tube of caulking 204 installed within the body of caulking gun 112.

The parts shown in the exploded small plunger section 132 are compacted together and secured onto the threaded section 130 by way of a combination of washers and a rear nut 124 and front nut 126. The caulking nozzle 208 of the small diameter caulking tube 212 is inserted into the large caulking gun and the small plunger 120 is engaged with the other end of the small diameter caulking tube 212. Actuation of the trigger 108 causing the rod 110 to move in a forward direction, forcing the small plunger 120 against the end of the small diameter caulking tube 212 which causes the caulk contained within to exude out through the caulking nozzle 208. The large plunger 122 can be seen to be slotted onto the rod 110, between the rear nut 124 and the rear end of the body of caulking gun 112.

Figure 3A:
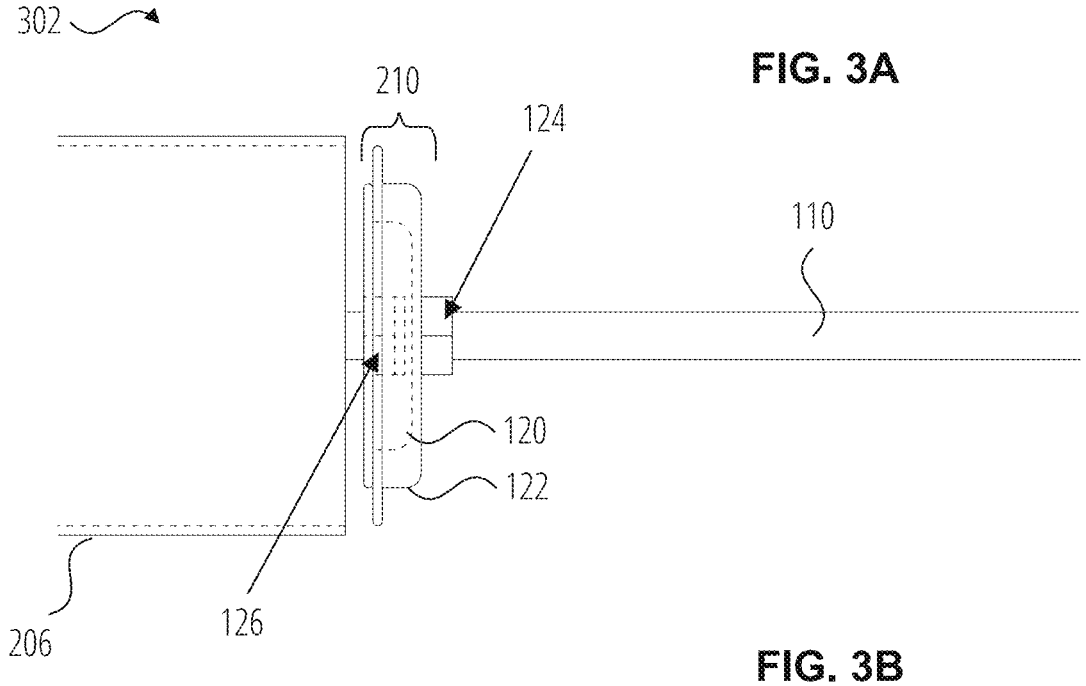
FIGS. 3A and 3B illustrate side cross-sectional views of the subject matter in accordance with one embodiment of the invention.

FIG. 3A shows a side cross-sectional view of a plunger configured for large tube of caulking 302.

The large diameter tube of caulking 206 can be seen with the small and large plunger 210 compacted together and threaded onto the rod 110, between the rear nut 124 and front nut 126, and abutting the end of the large diameter tube of caulking 206.

Figure 3B:
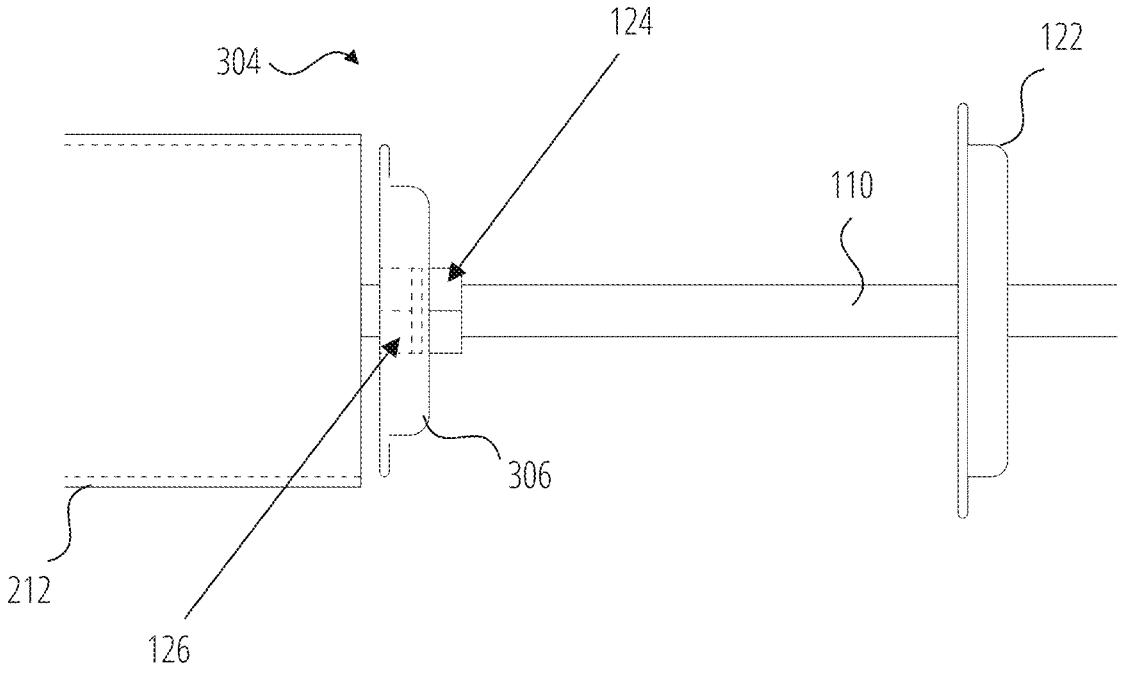

FIG. 3B shows a side cross-sectional view of a plunger configured for small tube of caulking 304.

The small diameter caulking tube 212 can be seen with the small plunger 120 threaded onto the rod 110, between the rear nut 124 and front nut 126, and abutting the end of the small diameter caulking tube 212.

In both embodiments illustrated in plunger configured for large tube of caulking 302 and plunger configured for small tube of caulking 304, washers may be inserted between the compacted small and large plunger 210 and the rear nut 124 and the front nut 126.

In some embodiments of the invention, the compacted small and large plunger 210 may be rotated through 180 degrees, such that the large plunger 122 abuts the end of the large diameter tube of caulking 206 and the small plunger 120 is closer to the end of the body of caulking gun 112.

Figure 4:
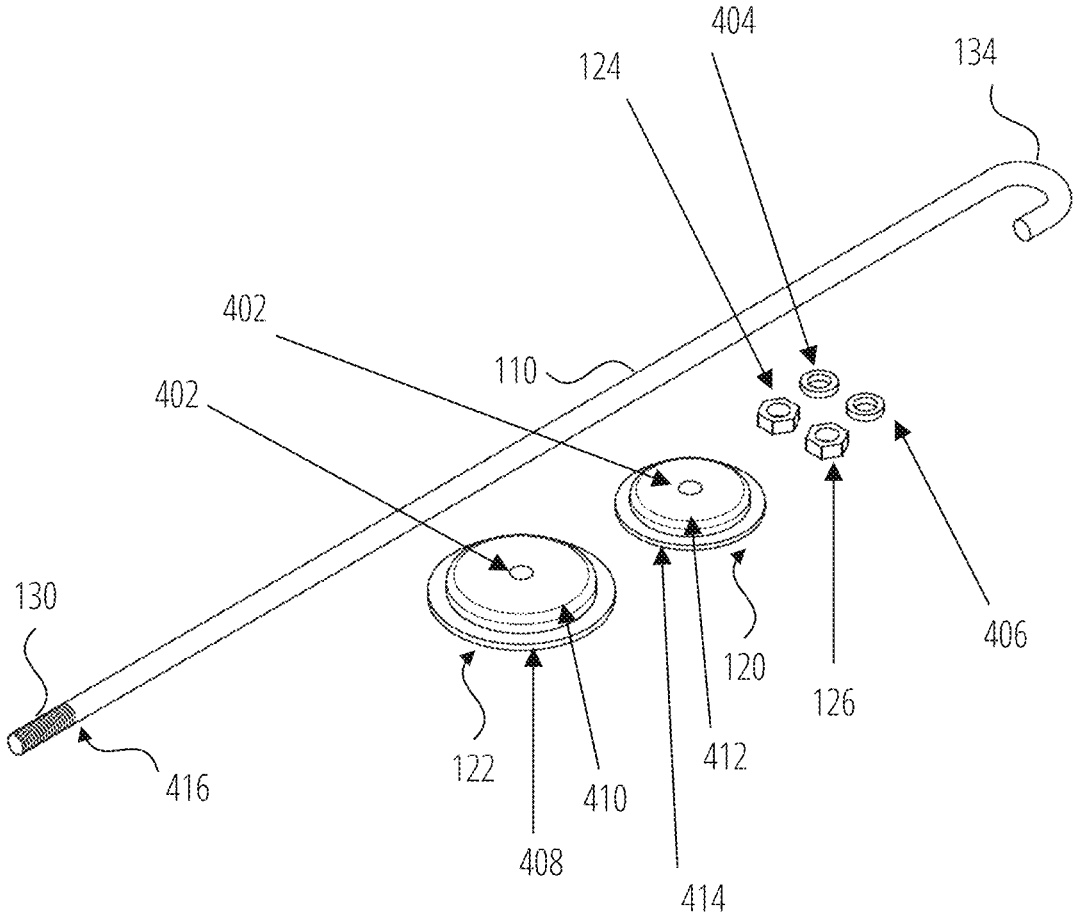
FIG. 4 illustrates an exploded view of parts of the subject matter in accordance with one embodiment.

FIG. 4 illustrates a kit of parts for retrofitting a standard large caulking gun to function as a universal caulking gun that can accommodate both large diameter tubes of caulking 206 and small diameter caulking tubes 212.

The rod 110 comprises a hook or end stop 134 at one end and a threaded section 130 at the other. The threaded section 130 has been extended from that found on standard caulking gun rods, which is necessary to accommodate the compacted small and large plunger 210, the rear nut 124, the rear washer 404, the front nut 126, and the front washer 406.

Furthermore, the threaded section 130 has been machined such that it has a smooth transition 416 at the rear most end. The rod 110 sections of known caulking guns have a ridge to prevent the plunger from moving down and along the rod 110.

The small plunger 120 and the large plunger 122 have central holes 402 that are sized such that they can be slotted onto the threaded section 130 and be able to move freely along the rod 110.

Moreover, in one embodiment of the invention, the small plunger 120 and the large plunger 122 have a flattened dome shaped structure. The inner circumference of large plunger 410 is sized to encompass the inner circumference of small plunger 412. The outer circumference of large plunger 408 is sized to fit within the inner circumference of a large diameter tube of caulking 206. The outer circumference of small plunger 414 is sized to fit within the inner circumference of a small diameter caulking tube 212.

The components of the kit for retrofitting a standard large caulking gun can be made from various known materials including, but not limited to: metals, alloys and plastics. The materials are chosen to be strong, rigid, hard wearing, avoiding corrosion and rusting. The metals are typically selected from steel, hardened steel, galvanized metals, and aluminum. The plastics are hard plastics that can be extruded, molded or 3D printed.

Examples of 3D printable plastics include, but are not limited to: polylactic acid, or PLA, this material has the benefit of being biodegradable as it is manufactured using renewable raw materials such as corn starch. ABS filament another type of 3D printing thermoplastic which contains a base of elastomers based on polybutadiene, making it more flexible, and resistant to shocks. ASA is a material that has similar properties to ABS, but has a greater resistance to UV rays. Polyethylene terephthalate, or PET, is ideal for fabricating larger more rigid frames. PETG, is a glycolyzed PET polymer that combines both the simplicity of PLA 3D printing and the strength of ABS, and it is 100% recyclable. Numerous other 3D printable polymers, hybrids and composites are known and considered to be within the scope of protection sought along with combinations thereof.

Plastics that are particularly suitable for injection molding include, but are not limited to: Lexan™; Nylon™; acrylics, which are particularly suitable for being tinted; polycarbonate (PC); polyoxymethylene (POM); polystyrene (PS); acrylonitrile butadiene styrene (ABS); polypropylene (PP); polyethylene (PE); thermoplastic polyurethane (TPU); and thermoplastic rubber (TPR) or combinations thereof.

Plastics that are particularly suitable for extrusion include but are not limited to: polyethylene (PE); polypropylene; acetal; acrylic; Nylon™; polyamides; polyvinyl chloride (PVC); acrylonitrile butadiene styrene (ABS); and polycarbonate or combinations thereof.

The foregoing descriptions of specific embodiments of the present invention have been presented for purposes of illustration and description. They are not intended to be exhaustive or to limit the invention and method of use to the precise forms disclosed. Many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A universal caulking gun, comprising:

a gun body, having a cartridge holder adapted for receiving a large or small caulk cartridge;

a rod movably assembled to the gun body, a first threaded end of said rod extending into the cartridge holder, a second end of said rod extending beyond said gun body;

a handle having a hingedly mounted trigger, said trigger operably associated with said rod to extend said first threaded end of said rod into said large or small caulk cartridge;

a small and a large plunger sized and configured to nest together and form a single plunger unit, wherein the small plunger is sized to correspond to an internal diameter of the small caulk cartridge or the large plunger is sized to correspond to an internal diameter of the large caulk cartridge, said small and large plungers having a central bore hole having a diameter corresponding to an external diameter of said rod; and a pair of threaded nuts sized and configured to engage with the first threaded end of said rod, wherein when said small and said large plungers are nested together and secured in place by said pair of threaded nuts, said first threaded end having a length to accommodate said single plunger unit and said pair of threaded nuts, said universal caulking gun can be used to apply caulk or adhesive to a work surface from either the small or large caulk cartridge.

2. The universal caulking gun of claim 1, additionally comprising a pair of washers sized and configured to engage with the first threaded end of said rod, being positioned in place either side of said small and said large plungers, when nested together, and secured in place by said pair of threaded nuts.

3. The universal caulking gun of claim 2, wherein when said large plunger is threaded onto said rod, and said small plunger is subsequently secured in place by said pair of threaded nuts, said universal caulking gun can be used to apply caulk or adhesive to said work surface from the small caulk cartridge.

4. The universal caulking gun of claim 3, additionally comprising a pair of washers sized and configured to engage with the first threaded end of said rod, being positioned in place either side of said small plunger, and secured in place by said pair of threaded nuts.

5. The universal caulking gun of claim 1, wherein said rod, said small plunger, said large plunger, and said pair of threaded nuts are individually fabricated from components selected from the group comprising: steel; hardened steel; galvanized metals; and aluminum.

6. The universal caulking gun of claim 1, wherein said small plunger and said large plunger are fabricated from hard plastics that can be extruded, molded or 3D printed.

7. A kit of parts to convert a standard caulking gun into a universal caulking gun, said kit comprising:

a rod having a first threaded end, configured to extend into a caulking tube holder of said standard caulking gun, and a second end of said rod extending beyond said standard caulking gun;

a small plunger and a large plunger sized and configured to nest together and form a single plunger unit, wherein the small plunger is sized to correspond to an internal diameter of a small caulking tube or the large plunger is sized to correspond to an internal diameter of a large caulking tube, said small and large plungers having a central bore hole having a diameter corresponding to an external diameter of said rod; and a pair of threaded nuts sized and configured to engage with the first threaded end of said rod, wherein when said small and said large plungers are nested together and secured in place by said pair of threaded nuts to form said universal caulking gun, said universal caulking gun can be used to apply caulk or adhesive to a work surface from either the small caulking tube or the large caulking tube.

8. The kit of claim 7, wherein said rod, said small plunger, said large plunger, and said pair of threaded nuts are individually fabricated from components selected from the group comprising: steel; hardened steel; galvanized metals; and aluminum.

9. The kit of claim 7, wherein said small plunger and said large plunger are fabricated from hard plastics that can be extruded, molded or 3D printed.

10. The kit of claim 7, additionally comprising a pair of washers sized and configured to engage with the first threaded end of said rod, said washers to be positioned in place either side of said small and said large plungers, when nested together, to be secured in place by said pair of threaded nuts.

11. The kit of claim 7, additionally comprising instructions for use.

12. A method of converting the standard caulking gun into the universal caulking gun, using the kit of claim 7, said method comprising:

removing the plunger rod from said standard caulking gun;

inserting said first threaded end of said rod into a caulking tube holder of said standard caulking gun;

threading one of said pair of threaded nuts onto said first threaded end of said rod;

slotting said nested small and large plungers onto said first threaded end of said rod;

threading another of said pair of threaded nuts onto said first threaded end of said rod to produce the single plunger unit;

applying the caulk or adhesive to the work surface via inserting the large caulking tube into said caulking tube holder of said universal caulking gun; and activating a trigger of the universal caulking gun to extend said nested small and large plungers into said large caulking tube.

13. The method of claim 12, further comprising sliding a washer, sized and configured to engage with the first threaded end of said rod prior to slotting said nested small and large plungers onto said first threaded end of said rod, and sliding a second washer, sized and configured to engage with the first threaded end of said rod prior to threading of said another of said pair of threaded nuts onto said first threaded end of said rod.

14. A method of converting the standard caulking gun into the universal caulking gun, using the kit of claim 7, said method comprising:

removing the plunger rod from said standard caulking gun;

inserting said first threaded end of said rod into the caulking tube holder of said standard caulking gun;

slotting said large plunger onto said rod;

threading one of said pair of threaded nuts onto said first threaded end of said rod;

slotting said small plunger onto said first threaded end of said rod;

threading another of said pair of threaded nuts onto said first threaded end of said rod to produce the single plunger unit;

applying the caulk or adhesive to the work surface via inserting the small caulking tube into said caulking tube holder of said universal caulking gun; and activating a trigger of the universal caulking gun to extend said small plunger into said small caulking tube.

15. The method of claim 14, further comprising sliding a washer, sized and configured to engage with the first threaded end of said rod prior to slotting said small plunger onto said first threaded end of said rod, and sliding a second washer, sized and configured to engage with the first threaded end of said rod prior to threading of said another of said pair of threaded nuts onto said first threaded end of said rod.

16. The kit of claim 7, further comprising: parts to replace individual components from said standard caulking gun.

* * * * *